US011111747B2

(12) United States Patent
Crow

(10) Patent No.: US 11,111,747 B2
(45) Date of Patent: Sep. 7, 2021

(54) DELIVERY TOOL FOR TUBULAR PLACEMENT OF AN ADAPTIVE SEAT

(71) Applicant: Disruptive Downhole Technologies, LLC, Houston, TX (US)

(72) Inventor: Stephen L. Crow, Humble, TX (US)

(73) Assignee: DISRUPTIVE DOWNHOLE TECHNOLOGIES, LLC, Houston, TX (US)

( * ) Notice: Subject to any disclaimer, the term of this patent is extended or adjusted under 35 U.S.C. 154(b) by 299 days.

(21) Appl. No.: 16/230,939

(22) Filed: Dec. 21, 2018

(65) Prior Publication Data

US 2020/0199958 A1 Jun. 25, 2020

(51) Int. Cl.

| | |
|---|---|
| ***E21B 23/06*** | (2006.01) |
| ***E21B 33/12*** | (2006.01) |
| ***E21B 23/04*** | (2006.01) |
| ***E21B 34/14*** | (2006.01) |

(52) U.S. Cl.

CPC ..... *E21B 23/06* (2013.01); *E21B 23/042* (2020.05); *E21B 23/0414* (2020.05); *E21B 33/1208* (2013.01); *E21B 34/14* (2013.01)

(58) Field of Classification Search

CPC ..... E21B 34/14; E21B 23/04; E21B 23/06; E21B 33/1208; E21B 23/0414; E21B 23/042

See application file for complete search history.

(56) References Cited

U.S. PATENT DOCUMENTS

| | | | |
|---|---|---|---|
| 2,618,343 | A | 11/1952 | Conrad |
| 2,670,797 | A | 3/1954 | Armentrout |
| 2,701,614 | A | 2/1955 | Ragan |
| 3,250,331 | A | 5/1966 | Boyle |
| 4,480,688 | A | 11/1984 | Rundell et al. |
| 4,872,710 | A | 10/1989 | Konecny et al. |
| 4,911,237 | A | 3/1990 | Melenyzer |
| 5,024,270 | A | 6/1991 | Bostick |
| 8,109,333 | B2 | 2/2012 | Yee |
| 9,482,071 | B2 | 11/2016 | Carrejo et al. |
| 9,556,704 | B2 | 1/2017 | Naedler et al. |
| 9,732,566 | B2 | 8/2017 | Mejia et al. |
| 9,810,035 | B1 | 11/2017 | Carr et al. |
| 9,828,833 | B2 | 11/2017 | Hofman et al. |
| 2004/0175229 | A1 | 9/2004 | Balsells |

(Continued)

FOREIGN PATENT DOCUMENTS

| | | | |
|---|---|---|---|
| WO | 2015084479 | A1 | 6/2015 |
| WO | 2016049771 | A1 | 4/2016 |

*Primary Examiner* — Christopher J Sebesta

(74) *Attorney, Agent, or Firm* — Steve Rosenblatt

(57) ABSTRACT

A delivery tool creates relative axial movement to retract a retaining sleeve from an adaptive seat so that the adaptive seat can release from the delivery tool and find support in a tubular string. The relative movement is created directly with a power charge acting on a piston attached to the retaining sleeve. Movement of the retaining sleeve releases support dogs that position the delivery tool when releasing the adaptive seat. The adaptive seat is protected for running in with a collapsible ring structure that passes through the adaptive seat opening when the delivery tool is pulled out of the hole. The retaining sleeve is replaced and the power charge is renewed to allow the delivery tool to be used more than once.

23 Claims, 2 Drawing Sheets

(56) References Cited

U.S. PATENT DOCUMENTS

| | | | | |
|---|---|---|---|---|
| 2007/0272420 | A1 | 11/2007 | Reimert et al. | |
| 2009/0159293 | A1 | 6/2009 | Jones et al. | |
| 2012/0012771 | A1 | 1/2012 | Korkmaz et al. | |
| 2012/0067583 | A1* | 3/2012 | Zimmerman | E21B 43/14 166/308.1 |
| 2012/0168178 | A1* | 7/2012 | Eriksen | E21B 23/04 166/382 |
| 2012/0305236 | A1 | 12/2012 | Gouthaman | |
| 2013/0319669 | A1 | 12/2013 | Dupree et al. | |
| 2014/0060813 | A1 | 3/2014 | Naedler et al. | |
| 2015/0027780 | A1* | 1/2015 | Hern | E21B 37/02 175/57 |
| 2015/0101823 | A1 | 4/2015 | Carrejo et al. | |
| 2015/0247375 | A1* | 9/2015 | Stout | E21B 33/1265 166/308.1 |
| 2016/0160620 | A1 | 6/2016 | Al-Gouhi | |
| 2016/0186511 | A1 | 6/2016 | Coronado et al. | |
| 2016/0312555 | A1 | 10/2016 | Xu et al. | |
| 2017/0107781 | A1 | 4/2017 | Kitzman et al. | |
| 2017/0226837 | A1 | 8/2017 | Kumar | |
| 2017/0321507 | A1* | 11/2017 | Crow | E21B 33/12 |
| 2017/0321513 | A1 | 11/2017 | Crow | |
| 2017/0321514 | A1 | 11/2017 | Crow | |
| 2018/0080298 | A1* | 3/2018 | Covalt | E21B 23/065 |

* cited by examiner

DELIVERY TOOL FOR TUBULAR PLACEMENT OF AN ADAPTIVE SEAT

FIELD OF THE INVENTION

The field of the invention is delivery tools that create relative axial movement to allow release and fixation of an adaptive seat to a support location in a tubular string and more particularly where the delivery tool is driven with a remotely set power charge.

BACKGROUND OF THE INVENTION

Setting tools for packers and plugs have been in use for a long time. These setting tools typically selectively retain a mandrel of a tool for running in while pushing on a setting sleeve for the tool being set. When the tool acted upon is fully set, the connection between the setting tool and the mandrel of the tool being set is shear released so that the setting tool can be pulled out of the hole. Typically the setting tool has an outer piston that abuts a setting sleeve of the tool being set so that a pickup force after setting allows the outer piston to move away from the setting sleeve of the tool being set. The mandrel of the setting tool breaks away from the mandrel of the tool being set for a full release of the setting tool from the tool being set. The source of the force for the relative movement in the setting tool can be an explosive charge that is remotely set to create internal pressure in the setting tool. Some typical setting tools that are used to set packers or plugs in this manner are U.S. Pat. Nos. 2,618,343 and 2,701,614. These setting tools released from a setting tool mandrel by shearing off a connecting link that had to be replaced after the setting tool was retrieved to the surface. The pressure created by the charge was used in conjunction fluid filled chambers to get the desired relative movement by maintaining the mandrel stationary and pressurizing the oil in the tool against a piston area that in turn moved the piston against a setting sleeve in a packer or bridge plug.

Later developments removed the oil chamber against the piston and used the pressure developed by a power charge directly to obtain relative movement between a setting tool mandrel and a setting tool piston. Such designs are shown in U.S. Pat. Nos. 5,024,270 and 9,810,035. Here again these setting tools focused on setting bridge plugs and packers.

More recently an adaptive seat was developed to replace packers or frack plugs for formation treatment procedures. The adaptive seat was a ring shaped support for an object that when landed on the adaptive seat would allow pressure buildup of the surrounding formation through openings in a tubular string located adjacent the landed object on the adaptive seat. The adaptive seat was delivered on a tool that held it in a compressed position. After locating in the desired location in the tubular string the delivery tool retracted a sleeve that allowed the adaptive seat to leave the tool and grow into a larger size. The adaptive seat could be delivered into a support location or recess in the tubular string or to be moved to the final location after release from the delivery tool. In essence the delivery tool retracted a sleeve, in one embodiment, so that the adaptive seat could grow in external and internal dimension for support in the tubular string while extending into the passage of the tubular string sufficiently to form a seat for an object to obstruct the passage. This sleeve was retracted with a setting tool similar to U.S. Pat. No. 2,618,343 sometimes known as an E4 Setting Tool sold by Baker Hughes, a GE Company. This assembly was shown in U.S. application Ser. No. 15/586,553 filed on May 4, 2017.

The present invention presents modifications for the delivery tool that retains the adaptive seat in the run in position and retracts the retaining sleeve with another tool that creates relative movement using the pressure developed from the power charge directly without use of intermediate oil filled chambers. The retraining sleeve of the delivery tool releases a delivery tool support while retracting the retaining sleeve from the adaptive seat so that the adaptive seat is first released with the delivery tool supported in a tubular string flowed by release of the delivery tool from support in the tubular string for removal from the borehole. The delivery tool provides a shield for the adaptive support during running in. After the adaptive support is located the shield is brought against the opening in the adaptive support and movement of the delivery tool out of the hole allows the shield to collapse to pass through the now set adaptive support. The retaining sleeve is preferably pulled up away from the adaptive support to release the adaptive support using a delivery tool with an internal power charge acting on a piston while avoiding the use of internal fluid filled chambers to drive a piston. The delivery tool is released for removal from the borehole as the retaining sleeve is shifted. These and other aspects of the present invention will be more readily apparent from a review of the description of the preferred embodiment and the associated drawings, while recognizing that the full scope of the invention is to be determined by the appended claims.

SUMMARY OF THE INVENTION

A delivery tool creates relative axial movement to retract a retaining sleeve from an adaptive seat so that the adaptive seat can release from the delivery tool and find support in a tubular string. The relative movement is created directly with a power charge acting on a piston attached to the retaining sleeve. Movement of the retaining sleeve releases support dogs that position the delivery tool when releasing the adaptive seat. The adaptive seat is protected for running in with a collapsible ring structure that passes through the adaptive seat opening when the delivery tool is pulled out of the hole. The retaining sleeve is replaced and the power charge is renewed to allow the delivery tool to be used more than once.

DETAILED DESCRIPTION OF THE PREFERRED EMBODIMENT

Figure 1:
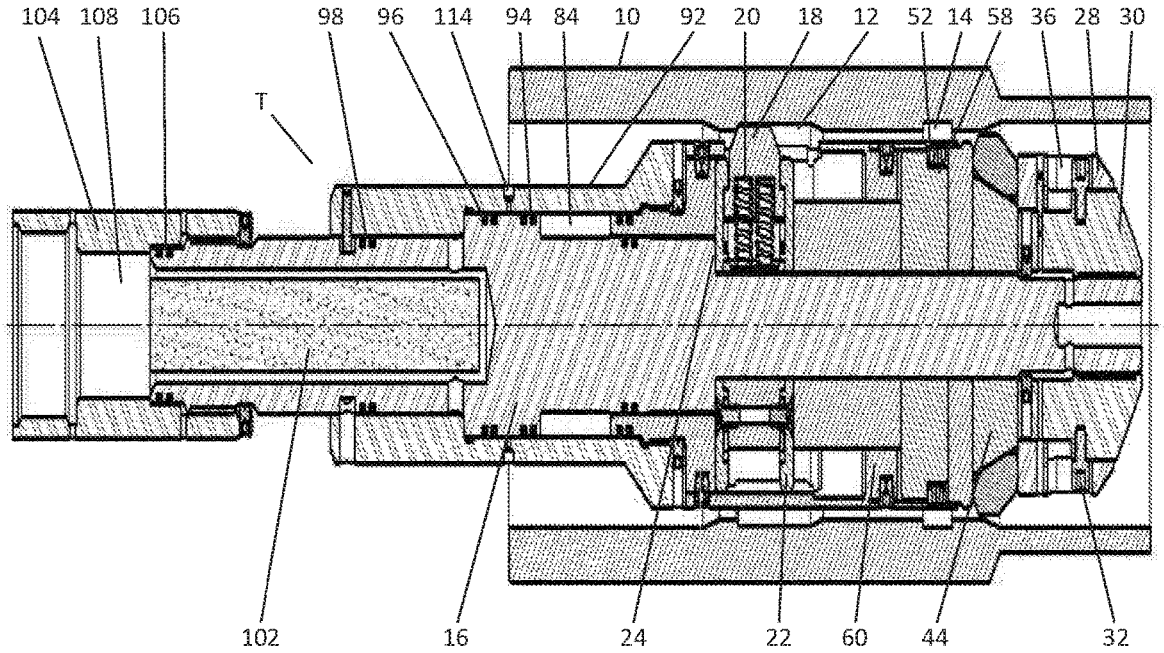
FIG. 1 is a section view of the delivery tool in the run in position.

A tubular string 10 has a support location 12 and a locating groove 14 located further downhole. Mandrel 16 of delivery tool T supports locating dogs 18 radially and outwardly biased by springs 20. Dog retainer 22 holds locating dogs 18 from release from the tool T. The retainer 22 abuts a shoulder 24 on mandrel 16. Retainer 22 is held against shoulder 24 by bottom nut assembly 26 which is formed by an outer ring 28 around an inner ring 30 with inner ring 30 threaded to mandrel 18. One or more fasteners 32 hold the outer ring 28 to the inner ring 30 for tandem rotation when securing nut assembly 26 to the mandrel 18. Multiple flats 34 on the outer ring 28 allow rotation of the nut assembly 26 with a wrench. Fasteners 32 are in an axial slot 36 to allow selective relative axial motion between the outer ring 28 and the inner ring 30 that is attached to mandrel 18 at thread 38 and secured with a set screw 40. One or more shear pins or breakable members 42 can shear to allow the relative movement of the outer ring 28 relative to the inner ring 30. Nut assembly 26 holds a series of ring structures starting with cone 44 around which are a series of dogs 46 that abut and stick out radially further than sleeve protector 48. Adaptive support annular ring 50 holds adaptive support 52 to mandrel 18 with the aid of retaining sleeve 54. Ring 50 abuts spacer 56, which abuts retainer 22. As a result the dogs 18 are axially spaced from adaptive seat or support 52 so that when the dogs 18 align with support location 12 the adaptive support 52 is aligned with groove 14. In FIG. 1 the retaining sleeve 54 keeps the adaptive support 52 retracted against annular ring 50 in recess 58 until the retaining sleeve 54 is axially retracted.

Figure 2:
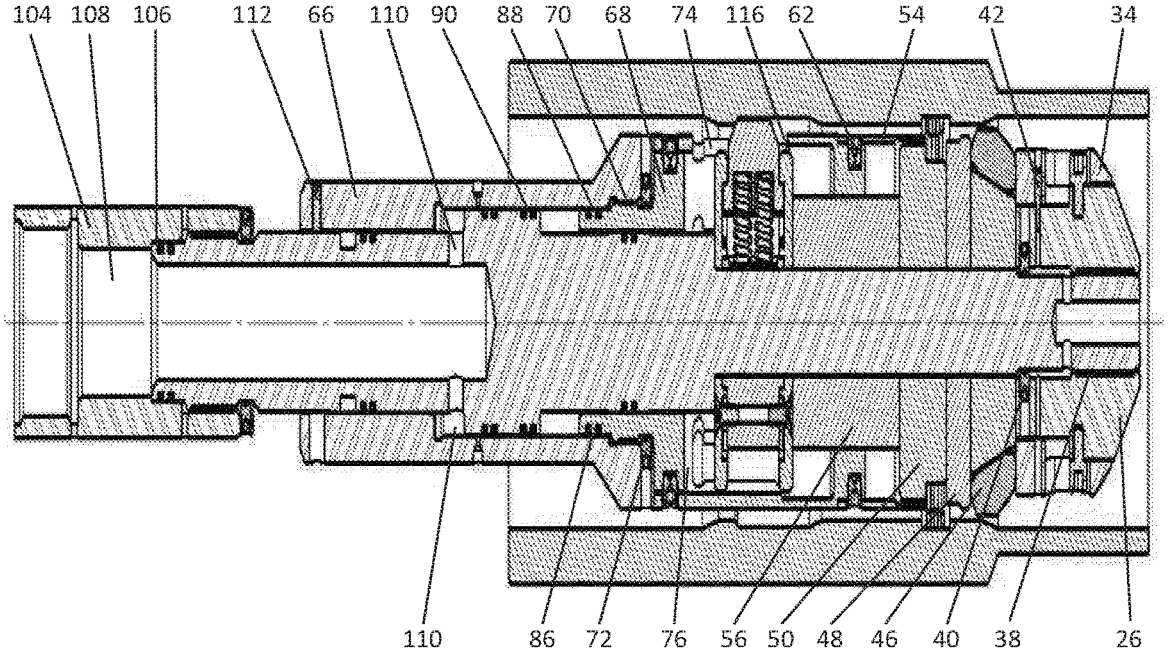
FIG. 2 is the view of FIG. 1 with the adaptive seat released from the delivery tool and the delivery tool released from the tubular string before the protective dogs for the adaptive ring collapse.
Figure 3:
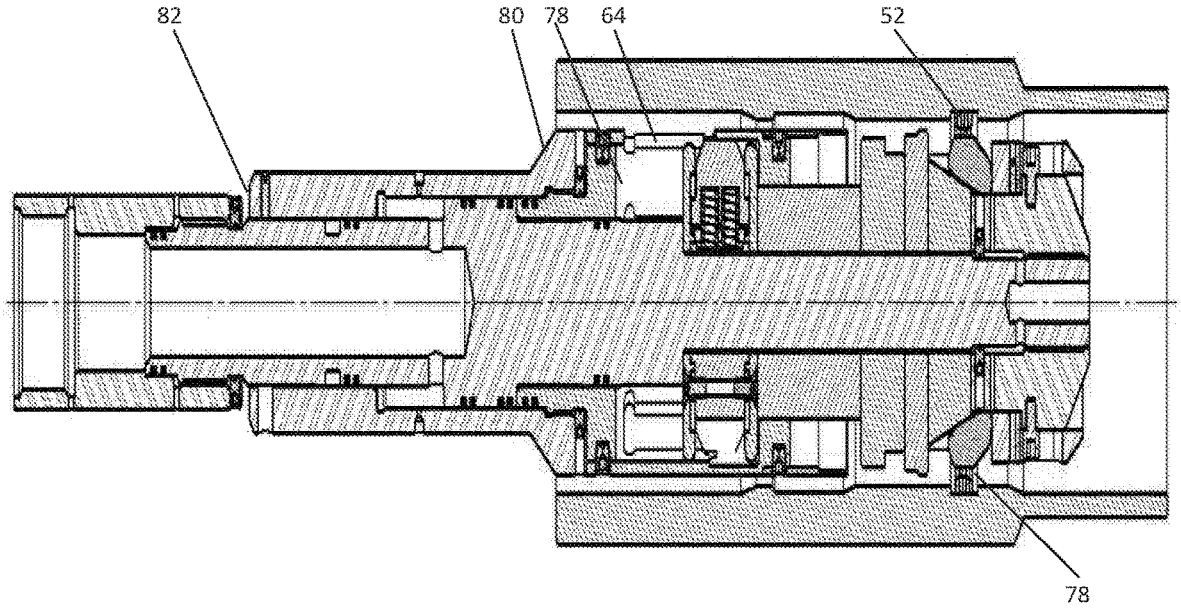
FIG. 3 is the view of FIG. 2 with the protective dogs collapsed for passing through the adaptive seat.

Retaining sleeve 54 has an internal ring 60 that rides on spacer 56. Sleeve 54 can be in multiple parts attached with at least one fastener such as 62. Axial slots 64 align with dogs 18 to allow retaining sleeve 54 to move uphole in tandem with outer piston 66. Outer piston 66 is connected to retaining sleeve 54 through a bottom ring 68 connected at thread 70 with the connection secured with at least one set screw 72. Piston 66 with bottom ring 68 are in hydrostatic pressure balance regardless of depth of tool T due to openings 74 that communicate into space 76 that enlarges as outer piston 66 is moved uphole. This happens because piston area 78 provides an uphole oriented hydrostatic force on outer piston 66 while piston areas 80 and 82 on outer piston 66 provide an equal and opposing downhole force regardless of the depth of the tool T. Chamber 84 is sealed with atmospheric pressure on assembly of the tool T and its volume is reduced on uphole movement of outer piston 66 while its internal pressure rises with volume reduction. Seal assemblies 86, 88 and 90 close off chamber 84 which is there to enable uphole movement of outer piston 66 until opposed surfaces 92 and 94 abut or simply draw closer to each other without contact. Seals 96 and 98 isolate chamber 100, which grows in volume as outer piston 66 moves uphole. Power charge 102 of a type known in the art is set from top sub 104 using a wireline that is not shown connected to an igniter that is not shown and located in or near the top sub 104. Seals 106 isolate chamber 108 where the power charge 102 is housed. The igniter that is not shown also has a seal for the uphole end of chamber 108. Passages 110 communicate pressure in chamber 108 that results from igniting the power charge 102 in chamber 108 to chamber 100. As chamber 100 builds pressure shear pin or pins 112 shear and the outer piston 66 moves uphole into the FIG. 2 position from the run in position of FIG. 1. The adaptive support 52 is enabled to move radially outwardly from recess 58 into support location 14 in tubular string 10 due to tandem movement of the outer piston 66 with retaining sleeve 54. Vent port 114, which is initially located between seal assemblies 94 and 96 on mandrel 16 shifts uphole with outer piston 66 to come into communication with chamber 100 to vent built up pressure that initially moved outer piston 66 from chambers 100 and 108 that communicate with each other through radial passages 110. In the FIG. 2 position, the power charge 102 has dissipated and is not shown and pressure is fully relieved from chambers 108 and 100 through vent ports 114. The vent ports can have a temporary plug in them that gets blown out with pressure in the FIG. 2 position. The temporary plug that is not shown can keep debris out of the port or ports 114 until the power charge 102 is set off. It should be noted that in the FIG. 2 position the dogs 18 are still in support location 12 so enhance the delivery of the adaptive support 52 radially into groove 14 can be facilitated. Sleeve 54 in the FIG. 2 position has moved uphole due to the presence of slots 64 whose lower end 116 has not yet engaged the dogs 18 for radial retraction of the dogs 18 as shown in FIG. 3. Those skilled in the art will appreciate that the movement from the FIG. 1 to the FIG. 3 position is virtually instantaneous when the power charge 102 is set off.

FIG. 3 shows an additional axial movement of the tool T after retaining sleeve 54 has fully moved uphole in tandem with outer piston 66. This further axial movement uphole brings dogs 46 in contact with an internal passage 118 in adaptive seat 52, which applies a shear force on shear pins 42 and allows the dogs 46 to slide down cone 44 to get to a smaller dimension to pass through internal passage 118 in adaptive support 52. This allows removal of the tool T through the positioned adaptive seat 52 now supported in groove 14. Once the adaptive support 52 is released from the tool T and set in position in groove 14 it no longer needs the run in protection afforded by sleeve protector 48. While for run in the dogs 46 extend radially out further than sleeve protector 48, this is because the sleeve protector 48, which has a fixed dimension needs to pass through internal passage 118. Dogs 46 which can be abutting to form a closed variable diameter ring for running in can protect the retaining sleeve 54 when running in but can then pass through the passage of the adaptive support 52 in the enlarged dimension of adaptive support 52 when retaining sleeve 54 is retracted and the adaptive support extends radially into groove 14.

The adaptive support can be released directly into groove 14 or offset from groove 14 and then moved axially into groove 14 preferably in an uphole direction when tool T is delivered on wireline (not shown). The detailed construction of the adaptive support 52 was described in detail in U.S. application Ser. No. 15/586,553 filed May 4, 2017 and incorporated by reference herein as if fully set forth. In brief, a ring like structure that can be delivered in a smaller dimension and grow to a larger dimension for support within a tubular string is contemplated. That dimension change can occur from a release of stored potential energy within the support, an application of an expansion mechanical force to the ring structure or other effects such as use of a shape memory material for the support that reverts to an enlarged dimension on exposure to heat from well fluids or artificially added into the well. In the supported position, a central passage through the adaptive support that is smaller than the tubular string passage is presented so that an object such as a sphere can be delivered to the adaptive support to land on it and close off the tubular string. Application of pressure in the string above the object effects a formation treatment of various types through tubular string openings made by a perforating gun or openings created by moving tubular string valves, for example.

Those skilled in the art will appreciate that a power charge is remotely set off to move a retaining sleeve away from an adaptive support for placement of the adaptive support in a supported location in a tubular string. The adaptive support is protected for running in with an assembly that exceeds the run in outer dimension of the retaining sleeve. The assembly that protects the retaining sleeve is mounted for a variable outer dimension to allow removal of the delivery tool after the adaptive support exits the delivery tool and assumes a supported position within the tubular string. Movement of the retaining sleeve also releases the support dogs that engage a profile in the tubular string to allow for alignment or near alignment of the adaptive support with its intended support location within the tubular string. The outer piston on the tool is configured to be in pressure balance from hydrostatic pressure regardless of the depth at which the delivery tool will be actuated. Stroking of the outer piston to release the adaptive support also vents internal pressure from the tool for the safety of personnel that disassemble the tool at the surface prior to reuse. All or part of the retaining sleeve can be disposable at a minor expense while the balance of the tool with a new power charge can be reused.

The above description is illustrative of the preferred embodiment and many modifications may be made by those skilled in the art without departing from the invention whose scope is to be determined from the literal and equivalent scope of the claims below.

I claim:

1. An adaptive seat delivery assembly for a tubular string, comprising:

a mandrel;

an outer piston being the sole piston supported on said mandrel, said mandrel and said outer piston selectively relatively movable;

an adaptive seat released from said mandrel responsive to said selective relative movement, said adaptive seat, upon being released, moving radially toward the tubular string for support therefrom;

said selective relative movement initiated by a power charge located in a power charge compartment in said mandrel, said power charge compartment in fluid communication to a surrounding annularly shaped outer piston compartment, said outer piston compartment formed by said mandrel nested in said outer piston to directly communicate gas pressure initiated by setting off said power charge to contact said outer piston in said outer piston compartment after passing through at least one radial port connecting said power charge compartment to said outer piston compartment.

2. The apparatus of claim 1, wherein:

said selective relative movement results in said outer piston and said adaptive seat becoming misaligned.

3. The apparatus of claim 1, further comprising:

a retaining sleeve for said adaptive seat moving in tandem with said outer piston;

at least one locating member axially spaced from said adaptive seat, whereupon movement of said retaining sleeve brings said retaining sleeve in contact with said at least one locating member to retract said at least one locating member radially toward said mandrel.

4. The apparatus of claim 3, further comprising:

an opening in said retaining sleeve through which said at least one locating member extends until an end of said opening in said retaining sleeve engages said at least one locating member to retract said locating member radially toward said mandrel.

5. The apparatus of claim 3, further comprising:

said retaining sleeve passing over said at least one locating member as a bias on said at least one locating member is overcome.

6. The apparatus of claim 3, further comprising:

said retaining sleeve selectively moving from a first position overlapping said adaptive seat to hold said adaptive seat retracted to said mandrel to a non-overlapping release position relative to said adaptive seat;

a protective sleeve supported on said mandrel on an opposite side of said adaptive seat from said at least one locating member.

7. The apparatus of claim 6, wherein:

said protective sleeve is articulated to a smaller dimension when engaging a passage through said adaptive seat, after said adaptive seat engages the tubular string, for removal of said mandrel from the tubular string.

8. The apparatus of claim 7, wherein:

said protective sleeve comprises a ring shape of protective members supported on a cone mounted to said mandrel, whereupon engagement of said protective members to said adaptive seat due to movement of said mandrel forces said protective members axially along a ramp defining said cone to a dimension smaller than said passage in said adaptive seat.

9. The apparatus of claim 8, wherein:

said protective members retained on said ramp with a sleeve selectively retained by a temporary retainer, said temporary retainer failing under said force from said movement of said mandrel to allow said protective members to move along said ramp.

10. The apparatus of claim 1, wherein:

a retaining sleeve for said adaptive seat moving in tandem with said outer piston, wherein movement of said retaining sleeve releases said adaptive seat from said mandrel and releases said mandrel from the tubular string after release of said adaptive seat from said mandrel.

11. The apparatus of claim 10, further comprising:

an articulated protective sleeve for said adaptive seat mounted to said mandrel selectively engageable to a passage through said adaptive seat after said adaptive seat is released from said mandrel to reduce the outer dimension of said articulated protective sleeve to allow passage of said articulated protective sleeve past said adaptive seat for removal of said mandrel from the tubular string.

12. The apparatus of claim 11, wherein:

said outer piston compartment comprising a singular variable volume piston chamber driving a singular outer piston when said variable volume piston chamber is enlarged with pressure from said power charge, said variable volume piston chamber defined between said mandrel and said outer piston.

13. The apparatus of claim 12, wherein:

a vent port associated with said outer piston selectively communicating with said variable volume piston chamber after a predetermined movement of said outer piston.

14. The apparatus of claim 13, wherein:

said vent port crossing over a mandrel mounted seal on movement of said outer piston for fluid communication with said variable volume piston chamber to vent pressure therefrom.

15. The apparatus of claim 10, wherein:

said retaining sleeve further comprising an internal ring support on said mandrel.

16. The apparatus of claim 1, wherein:

said pressure from said power charge is limited in force to release a retaining member holding said outer piston to said mandrel and thereafter to create relative axial movement between a retaining sleeve and said adaptive seat by overcoming a friction force exerted by potential energy stored in said adaptive seat and acting against said retaining sleeve until said adaptive seat is clear of said retaining sleeve such that the potential energy in said adaptive seat is released to move said adaptive seat to contact the surrounding tubing.

17. An adaptive seat delivery assembly for a tubular string, comprising:

a mandrel;

an outer piston supported on said mandrel, said mandrel and said outer piston selectively relatively movable;

an adaptive seat released from said mandrel responsive to said selective relative movement, said adaptive seat, upon being released, moving radially toward the tubular string for support therefrom;

said selective relative movement initiated by a power charge associated with said piston;

a retaining sleeve for said adaptive seat moving in tandem with said outer piston;

at least one locating member axially spaced from said adaptive seat, whereupon movement of said retaining sleeve brings said retaining sleeve in contact with said at least one locating member to retract said at least one locating member radially toward said mandrel;

an opening in said retaining sleeve through which said at least one locating member extends until an end of said opening in said retaining sleeve engages said at least one locating member to retract said locating member radially toward said mandrel; and said opening in said retaining sleeve providing access to a bottom of said outer piston, said bottom having the same piston area as a top to said outer piston to put said outer piston in pressure balance to fluids in the tubular string.

18. An adaptive seat delivery assembly for a tubular string, comprising:

a mandrel;

an outer piston supported on said mandrel, said mandrel and said outer piston selectively relatively movable;

an adaptive seat released from said mandrel responsive to said selective relative movement, said adaptive seat, upon being released, moving radially toward the tubular string for support therefrom;

said selective relative movement initiated by a power charge associated with said outer piston;

said outer piston comprising opposed piston surfaces exposed to pressure around the tubing string, said opposed surfaces comprising substantially equal areas so that any net force on said outer piston from the pressure around the tubing string will not move said outer piston against a breakable retainer holding said outer piston to said mandrel.

19. An adaptive seat delivery assembly for a tubular string, comprising:

a mandrel;

a single piston supported on said mandrel, said mandrel and said piston selectively relatively movable;

an adaptive seat released from said mandrel responsive to said selective relative movement, said adaptive seat, upon being released, moving radially toward the tubular string for support therefrom;

said selective relative movement initiated by a power charge located in a power charge compartment in said mandrel, said power charge compartment defined at least in part by said single piston, such that gas pressure initiated by setting off said power charge is directly applied to said single piston to create said selective relative movement which results in said adaptive seat and a surrounding retaining sleeve becoming misaligned for said release of said adaptive seat to move toward the tubular.

20. The apparatus of claim 19, wherein:

said gas pressure from said power charge is used exclusively to release a retaining member holding said piston to said mandrel and to create relative axial movement between said retaining sleeve and said adaptive seat by overcoming a friction force exerted by potential energy stored in said adaptive seat and acting against said retaining sleeve, until said adaptive seat and said retaining sleeve are radially clear of each other.

21. The apparatus of claim 19, further comprising:

a retaining sleeve for said adaptive seat moving in tandem with said single piston;

at least one locating member axially spaced from said adaptive seat, whereupon movement of said retaining sleeve brings said retaining sleeve in contact with said at least one locating member to retract said at least one locating member radially toward said mandrel.

22. The apparatus of claim 21, further comprising:

an opening in said retaining sleeve through which said at least one locating member extends until an end of said opening in said retaining sleeve engages said at least one locating member to retract said locating member radially toward said mandrel; and said opening in said retaining sleeve providing access to a bottom of said outer piston, said bottom having the same piston area as a top to said outer piston to put said outer piston in pressure balance to fluids in the tubular string.

23. The apparatus of claim 19, wherein:

said pressure from said power charge is limited in force to release a retaining member holding said single piston to said mandrel and thereafter to create relative axial movement between a retaining sleeve and said adaptive seat by overcoming a friction force exerted by potential energy stored in said adaptive seat and acting against said retaining sleeve until said adaptive seat is clear of said retaining sleeve such that the potential energy in said adaptive seat is released to move said adaptive seat to contact the surrounding tubing.

* * * * *